US005953875A

United States Patent [19]

Harkins

[11] Patent Number: 5,953,875

[45] Date of Patent: Sep. 21, 1999

[54] SLIDE-IN BUILDING INSULATION SYSTEM

[76] Inventor: Daniel J. Harkins, 113 W. McKinley St., Stoughton, Wis. 53589

[21] Appl. No.: 08/762,558

[22] Filed: Dec. 9, 1996

[51] Int. Cl.[6] ..... E04B 1/74

[52] U.S. Cl. ..... 52/407.3; 52/404.5; 52/406.2; 52/410; 52/273; 52/746.11; 160/392; 160/395

[58] Field of Search ..... 52/404.1, 404.5, 52/406.1, 406.2, 407.3, 407.4, 408, 410, 746.11, 273; 160/392, 395, 273.1

[56] References Cited

U.S. PATENT DOCUMENTS

| | | | |
|---|---|---|---|
| 2,839,126 | 6/1958 | O'Neill | 160/392 |
| 2,950,727 | 8/1960 | Dunn | 160/392 X |
| 3,051,232 | 8/1962 | Lamb | 160/273.1 X |
| 3,323,819 | 6/1967 | Barker | 160/392 |
| 3,875,623 | 4/1975 | Johnston | 160/392 X |
| 4,337,815 | 7/1982 | Lindström | 160/392 |
| 4,446,664 | 5/1984 | Harkins | 52/404 |
| 4,573,298 | 3/1986 | Harkins | 52/404 |
| 4,744,403 | 5/1988 | Hausmann et al. | 160/273.1 X |
| 4,903,629 | 2/1990 | Maudlin et al. | 160/392 X |
| 4,935,995 | 6/1990 | Daus, Jr. | 160/392 X |
| 5,002,111 | 3/1991 | Boiteau | 160/395 X |
| 5,333,425 | 8/1994 | Nickerson et al. | 160/392 X |
| 5,442,890 | 8/1995 | Fligg | 52/404.5 |
| 5,535,560 | 7/1996 | Fligg | 52/407.3 X |
| 5,581,966 | 12/1996 | Fligg | 52/404.5 X |
| 5,636,487 | 6/1997 | Fligg | 52/404.5 |

*Primary Examiner*—Carl D. Friedman
*Assistant Examiner*—Yvonne Horton-Richardson
*Attorney, Agent, or Firm*—Zarley, McKee, Thomte Voorhees & Sease; Dennis L. Thomte

[57] ABSTRACT

A slide-in building insulation system wherein a plurality of slide tracks are secured in spaced parallel relation to a plurality of secondary structural members which are extended longitudinally between oppositely situated primary structural members of the building roof structure and/or walls. An elongated suspension sheet, including a flexible fabric extended between thicker guide strips along each edge thereof, is slide-fit into place with the guide strips being received within and advanced through the slide tracks so that the suspension sheet covers the space between adjacent slide tracks. An edge suspension sheet covers the space between a primary structural member and an adjacent slide track, each edge suspension sheet having a guide strip along only one side edge thereof and an opposite side edge adapted to be secured to the primary structural member. Curved connectors in the side tracks at the junction of the roof structure and wall, and a flared feed-in fitting on the end of each slide track may facilitate slide-in advancement of the suspension sheet during installation. The invention is further directed to a method of covering and sealing the roof structure and/or walls of a building with the slide-in building insulation system.

32 Claims, 5 Drawing Sheets

SLIDE-IN BUILDING INSULATION SYSTEM

BACKGROUND OF THE INVENTION

1. Technical Field

The present invention is directed generally to building insulation systems and, more particularly, to an improved system for installing a vapor barrier and thermal insulation over the roof structure and/or walls of a building.

2. Description of the Prior Art

The inventor of the building insulation system and method described herein previously devised the building insulation system described in his prior U.S. Pat. Nos. 4,446,664 and 4,573,298, which are marketed under the trademark SIMPLE SAVER SYSTEM®. That system enabled the installation of an effective vapor barrier across the entire roof structure and walls of a building on a gridwork of suspension bands so that the installed system somewhat resembled a suspension ceiling. Some prospective customers have an erroneous initial perception that the Simple Saver System is difficult to install, perhaps because of the many fasteners used to secure the band support system in place.

Accordingly, it is a primary object of the present invention to provide an improved building insulation system and method of installing that system.

Another object of the invention is to provide a slide-in building insulation system wherein a suspension sheet is slid into place along slide tracks arranged in parallel spaced relation across a roof structure and/or walls of a building.

Another object of the invention is to provide a slide-in building insulation system which may be quickly and safely installed.

Another object of the invention is to provide a slide-in building insulation system which incorporates standardization of the suspension sheet sizes.

Another object of the invention is to provide a slide-in building insulation system which is readily installed on any type of wall or roof construction.

Another object of the invention is to provide a slide-in building insulation system which may be installed with less weather exposure while roofing.

Another object of the invention is to provide a slide-in building insulation system adaptable for retro-fit installation after the roof is on the building and allowing for insulation to be fed or blown in from the sides where the edge suspension sheets are installed.

Another object of the invention is to provide an improved building insulation system requiring less manual labor for installation.

Another object of the invention is to provide an improved building insulation system wherein each suspension sheet can be drawn across the building by a motorized cable.

Another object of the invention is to provide an improved building insulation system requiring fewer through fasteners in the suspension sheets, thereby to yield an improved vapor barrier.

Another object of the invention is to provide an improved building insulation system wherein edge suspension sheets are sealed to the rafters or primary structural members by contact sealant, double-stick tape or with mechanical fasteners in the same manner that edges are sealed in the Simple Saver System.

Another object of the invention is to provide an improved building insulation system wherein the slide tracks for supporting the suspension sheets double as electrical conduits.

Another object of the invention is to provide an improved building insulation system which is simple to install, thereby substantially eliminating the field training of crews.

Another object of the invention is to provide an improved building insulation system enabling thermal insulation to be installed in the same manner as in the prior Simple Saver System.

Another object of the invention is to provide an improved building insulation system wherein the vapor barrier sheet may be installed with or without thermal insulation.

Another object of the invention is to provide an improved building insulation system wherein the suspension sheet is installed to be taut and provide an attractive uniform appearance.

Another object of the invention is to provide an improved building insulation system which is simple and rugged in construction, economical to manufacture and install and efficient in operation.

SUMMARY OF THE INVENTION

A building insulation system for covering and sealing the roof structure and/or walls of a building includes the following elements. An elongated suspension sheet has a pair of guide strips and a flexible fabric connected to and extended between the pair of guide strips, the guide strips each being of substantially greater thickness than the flexible fabric. One guide strip is arranged along each side edge of the suspension sheet.

A first pair of slide tracks are secured to the roof structure and/or wall in parallel spaced-apart relation, which slide tracks include a right slide track, having a guide strip receiving channel and a slit along the length thereof, and a left slide track, having a guide strip receiving channel and a slit along the length thereof, the slits having a thickness to accommodate passage of the flexible fabric therethrough.

The suspension sheet is supported on and extended along the length of the slide tracks with one guide strip being received within the guide strip receiving channel of the left slide track and the other guide strip being received within the guide strip receiving channel of the right slide track, whereby the flexible fabric extends through the slits in the right and left slide tracks to cover the space between the slide tracks.

The slide tracks may be provided as dual slide tracks, each including right and left slide tracks arranged back-to-back with oppositely facing slit for supporting adjacent side edges of adjacent suspension sheets. The right and left slide tracks of the dual slide track may be spaced-apart and connected by a center flange for defining an open-bottomed central channel which may double as an electric conduit. A closure strip may be provided which may be snap fit or otherwise secured over the open-bottomed central channel to enclose it.

A series of dual slide tracks may be extended across the building roof structure and down the opposite side walls to accommodate slide-in installation of a continuous length of suspension sheet along the length of the slide tracks. Curved connectors may be provided at the junction of the roof structure and each wall to facilitate sliding installation of the suspension sheet along the slide tracks at that position. Likewise, a flared feed-in fitting may be provided on one end of each slide track to guide the flexible fabric of the suspension sheet into the slit of each slide track.

The invention is further directed to the method of insulating the roof structure and/or walls of a building including the steps of providing the elongated suspension sheets and pairs of slide tracks, securing the slide tracks to the roof structure and/or walls in parallel spaced-apart relation, and installing the suspension sheets by inserting the guide strips thereof into respective right and left slide tracks of respective pairs of slide tracks and sliding the suspension sheets along the length of the slide tracks to cover the space between them. The suspension sheet is preferably installed taut between the slide tracks. Series of dual slide tracks may be installed in spaced-apart parallel relation to cover wide expanses of a building roof structure and/or walls.

A dual slide track may be secured at a position in adjacent parallel spaced relation from each rafter or primary structural member so that an edge suspension sheet having a guide strip along one side edge thereof may be slide-fit into that slide track with the opposite side edge of the edge suspension sheet being secured to the rafter or primary structural member by contact sealant, double-stick tape, mechanical fasteners or any other known fastening means such as those used in the past in connection with the Simple Saver System.

Upon installation of the slide tracks, cables may be extended throughout the length of the slide tracks and connected to a suspension sheet so that, upon drawing the cables back through the slide tracks with a winch or the like, the suspension sheet is automatically advanced in a sliding movement to its fully installed position across substantially the full length of the slide tracks.

The system of the invention results in a tight, uniform suspension sheet covering for the roof structure and/or walls of a building. Thermal insulation will generally be installed in the space between the suspension sheet and roof structure or wall but the suspension sheet can alternately be installed with a thin layer of insulation adhered to it prior to pulling it into place, or with no thermal insulation.

DESCRIPTION OF THE PREFERRED EMBODIMENTS

Whereas the system of the invention for covering and sealing the roof structure and walls of a building according to the present invention is adapted for use with any type of roof or wall structures, it will be described in connection with a metal building.

Figure 1:
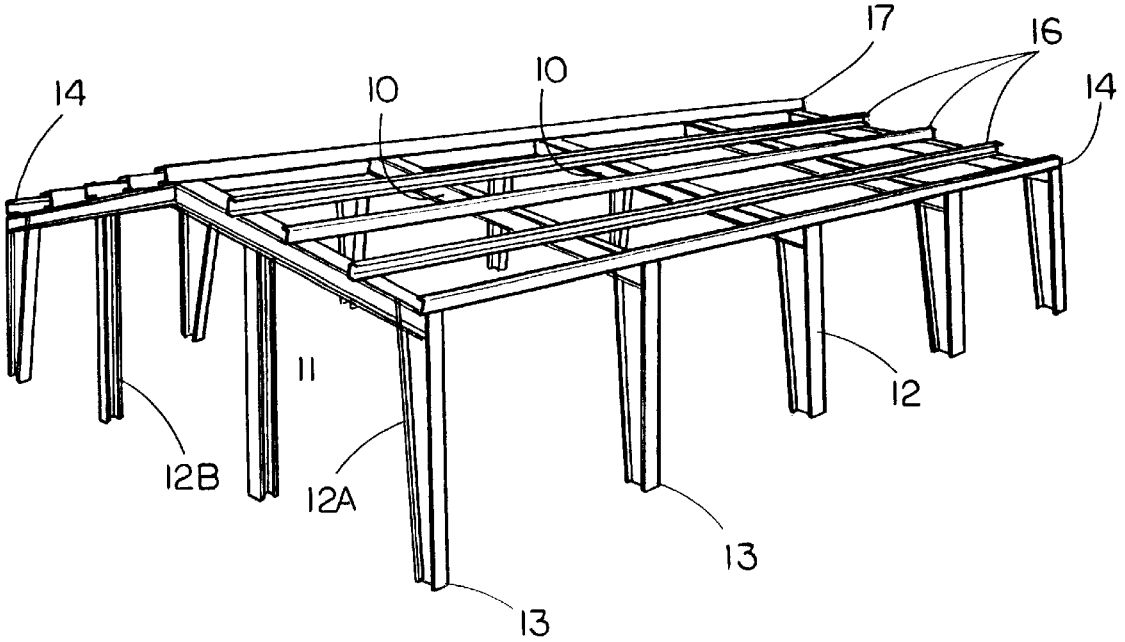
FIG. 1 is a perspective view of a typical metal building structure.
Figure 2:
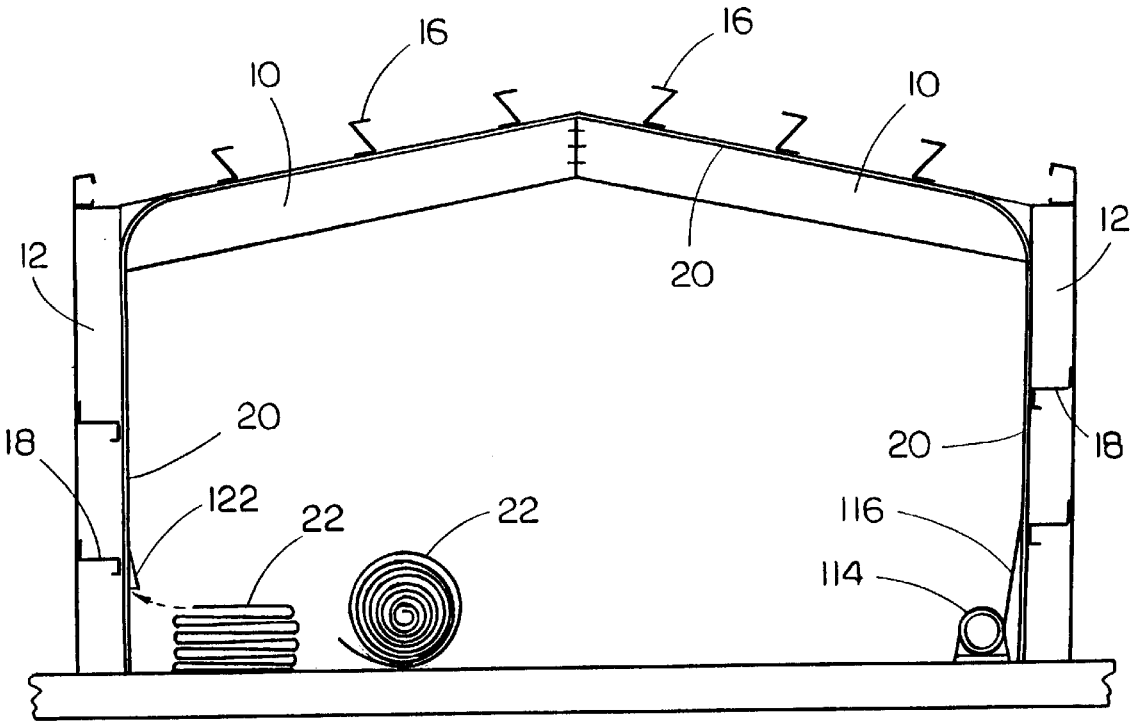
FIG. 2 is a transverse sectional view through the building structure illustrating the system of the invention for covering and sealing the walls and roof structure.

The structural members of a typical metal building are illustrated in FIG. 1. A vertical support for the roof is provided by rafter columns 12, positioned along the side walls of the building, end wall corner columns 12A, positioned at the corners of the building, and end wall columns 12B, positioned in the end walls of the building. Rafters 10, positioned at the top of the columns 12, 12A and 12B, span the building transversely, creating a series of open spaces between rafters 10, commonly referred to as "bays" 13 in the construction arts. Eave struts 14, positioned at the end of the rafters 10, run the length of the building wall and provide lateral support between columns 12 and 12A. Purlins 16, attached to the upper surface of the rafters 10, are placed in spaced parallel arrangement and run the length of the building between end wall rafters 11. Purlins 16 may have a "Z" shape, as illustrated in FIG. 2, a "C" shape or any other shape having a flat interior surface. All such purlins 16, as well as bar-joists (not shown) which are sometimes used instead of purlins, are compatible with the system of the present invention. Girts 18 are illustrated in FIG. 2 as extending between rafter columns 12 for supporting the building wall covering.

The roof structure rafters 10 and columns 12, 12A and 12B are collectively referred to herein as primary structural members whereas the bar joists or purlins 16 and girts 18 are referred to as secondary structural members. In the roof structure, side walls and end walls, the secondary structural members are connected in spaced-apart relation and extended between spaced-apart parallel primary structural members.

The system for covering and sealing the roof structure and walls of a building according to the present invention is illustrated in FIG. 2. In each bay 13 of the building, pairs of elongated slide tracks 20 are secured to the secondary structural members in spaced-apart parallel relation and preferably extend up one side wall, across the roof structure and down the opposite side wall, as shown. An elongated suspension sheet 22 has side edges supported within the slide tracks so that the suspension sheet may be drawn up one side wall, across the roof structure and down the opposite side wall to substantially cover and seal the space between each pair of slide tracks 20.

Figure 5:
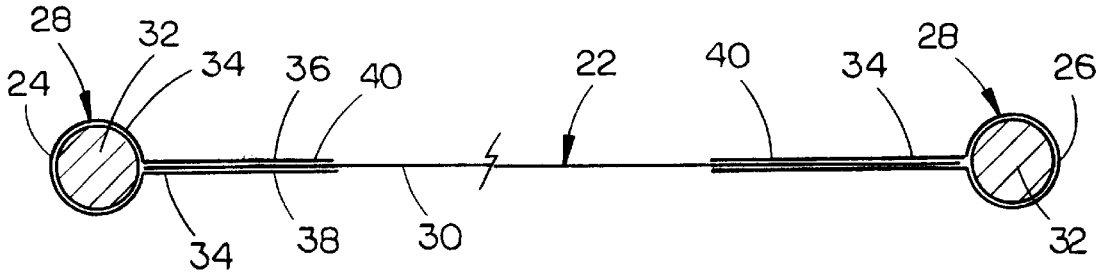
FIG. 5 is a foreshortened end view of a suspension sheet of the system.
Figure 6:
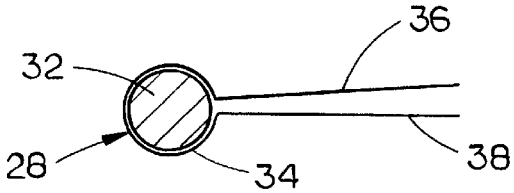
FIG. 6 is a foreshortened perspective view of the edge cover for the suspension sheet of FIG. 5.

FIG. 5 illustrates a preferred embodiment of a suspension sheet 22. An elongated suspension sheet 22 has opposite side edges 24 and 26, a guide strip 28 along each side edge 24 and 26 and a flexible fabric 30 connected to and extended between the pair of guide strips 28. The flexible fabric 30 is preferably a vapor barrier material such as a high density polyethylene. The guide strips 28 are of substantially greater thickness than the flexible fabric 30 so as to be retained within the slide tracks 20.

In the illustrated embodiment, guide strip 28 includes a rope or cord 32 connected to the flexible fabric 30 by an edge cover 34 which may be a strip of fabric such as canvas, folded approximately in half with the cord 32 arranged along the fold and the two half sections 36 and 38 secured to the top and bottom surfaces of the flexible fabric 30 by any suitable means. Extrusion welding is a preferred means for securing the edge cover onto the flexible fabric because it provides a super strong connection that cannot be pulled apart, which is vapor retardant and which does not require sew holes. Molten resin 40 is extruded onto each side of the edge cover 34 and actually melts into the coating on the canvas material of the edge cover 34. That coating is preferably of the same material as the flexible fabric 30. That material is preferably a high density polyethylene although other fabrics could also be used. The edge cover 34 thus secures a thick cord 32 along each side edge 24 and 26 of suspension sheet 22 for receipt within the slide tracks 20.

Figure 7:
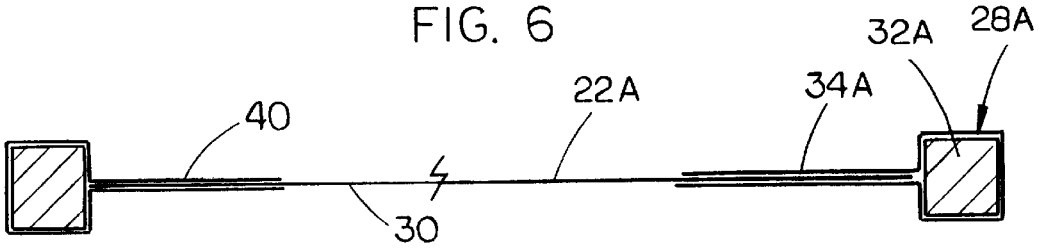
FIG. 7 is an end view of an alternate suspension sheet of the system.

FIG. 7 illustrates an alternate embodiment of a suspension sheet wherein a square section cord 32A is secured within each guide strip 28A.

Figure 8:
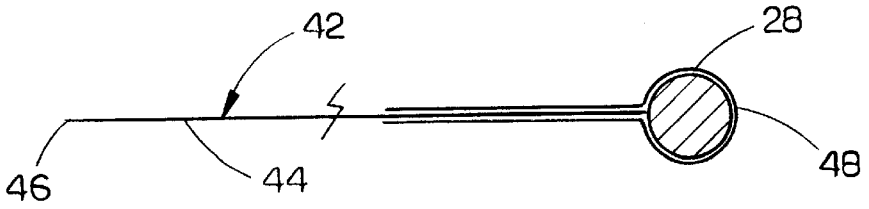
FIG. 8 is an end view of an edge suspension sheet of the system.

FIG. 8 illustrates an edge suspension sheet 42 including an elongated flexible fabric strip 44 having opposite side edges 46 and 48 and one guide strip 28 secured to one side edge for receipt within a slide track 20, as described below. The edge suspension sheets 42 are preferably provided in various widths to accommodate any building size.

The use of the variable size edge suspension sheets 42 enables standardization of the sizes of the suspension sheets 22. The following chart lists preferred suspension sheet widths for various standard width building bays.

| Suspension Sheet Width | Building Bay Width |
|---|---|
| 9' | 20' (2-wide) |
| 11'9" | 24' and 25' (2-wide) |
| 18'6" | 20' |
| 23'6" | 24' and 25' |

Note that the 9' and 11'9" wide suspension sheets 22 would not require factory seaming since they could be made from standard roll goods.

Figure 9:
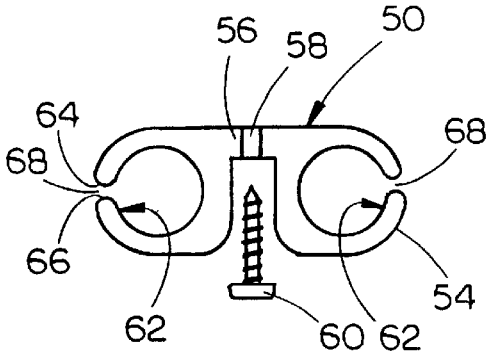
FIG. 9 is an end view of one embodiment of a dual slide track of the invention.

FIGS. 9–16 illustrate several possible embodiments for the slide tracks of the invention. FIG. 9 illustrates a dual slide track 50 including a right slide track 52 and a left slide track 54 of an integral extrusion including a connecting center flange 56 having spaced screw holes 58 for securement to secondary structural members of the building by screws 60. Each slide track 52 and 54 includes a generally C-shaped C-channel 62 having spaced-apart edges 64 and 66 defining a slit 68 along the length of the slide track. The C-channel is of a size and shape for slidably receiving round guide strip 28 shown in FIGS. 5 and 8. Slit 68 has a thickness greater than the thickness of flexible fabric 30 but substantially less than the thickness of guide strip 28 to accommodate passage of flexible fabric 30 through it. In the dual slide track 50 of FIG. 9, right and left slide tracks 52 and 54 are arranged back-to-back with oppositely facing slits for supporting adjacent side edges of adjacent suspension sheets 22 or 42.

Figure 10:
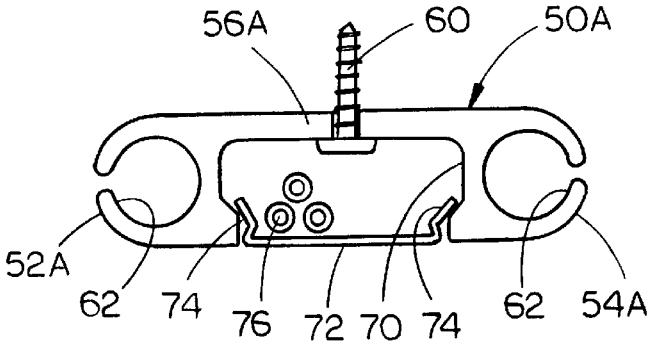
FIG. 10 is an end view of an alternate dual slide track of the invention with the snap-in closure strip for enclosing wires within the central channel thereof.

FIG. 10 illustrates an alternate dual slide track 50A having right and left slide tracks 52A and 54A formed as an integral extrusion with a wider center flange 56A partially defining an open-bottomed central channel 70 with right and left C-channels 62. A removable elongated closure strip 72 has resilient upstanding side flanges 74 enabling it to be snap-fit into and from the center channel to perform the dual function of serving as an electrical conduit for building wires 76.

Figure 11:
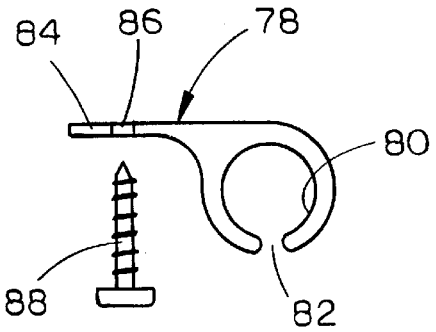
FIG. 11 is an end view of a single slide track of the invention.

FIG. 11 discloses a single slide track 78 defining a guide strip receiving C-channel 80 and a slit 82 along the length thereof. The means for securing the C-channel 80 to a plurality of the building secondary structural members is the support flange 84 extended outwardly from the C-channel 80, which flange has a plurality of spaced-apart screw holes 86 for receiving fastener screws 88.

Figure 12:
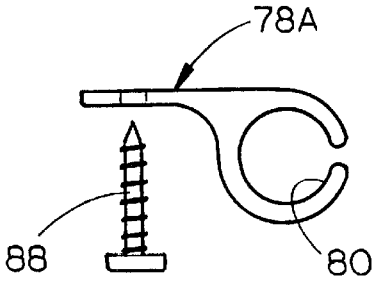
FIG. 12 is an end view of an alternate single slide track of the invention.

An alternate single slide track 78A is shown in FIG. 12. It is identical to the single slide track of FIG. 11 except that the C-channel 80 is rotated 90° to open to the outside in the orientation illustrated in FIG. 12.

Figure 13:
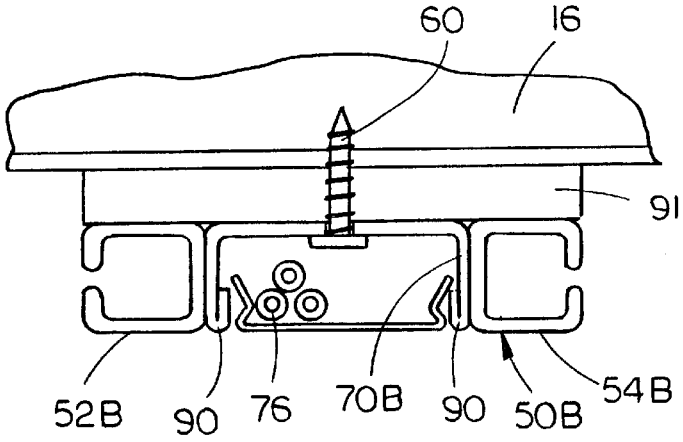
FIG. 13 is an end view of an alternate dual slide track of the invention installed with a thermal block between it and the roof structure or wall on which it is mounted.

FIG. 13 illustrates an alternate dual slide track 50B wherein a generally rectangular central channel 70B is either integrally formed with or otherwise secured to a pair of right and left slide tracks 52B and 54B having a generally square size and shape for slidably receiving the generally square guide strips 28A of the suspension sheet illustrated in FIG. 7. Central channel 70B has a pair of inwardly directed generally J-section flanges 90 of a size and shape to cooperate with the closure strip 72 to provide for the snap-fit connection of the closure strip over the open bottom end of central channel 70B. FIG. 13 also illustrates a thermal block 91 such as a rectangular plate of styrofoam or the like which is inserted between the slide track and wall or roof structure to reduce thermal conduction. Thermal block 91 is illustrated between dual slide track 50B and purlin 16. The size, shape and material of the thermal block may be selected as desired to accomplish the thermal insulation function.

Figure 14:
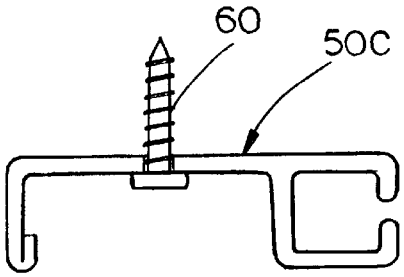
FIG. 14 is an end view of an alternate single slide track of the invention with an integral conduit channel for receiving the suspension sheet of FIG. 7.

FIG. 14 illustrates a single slide track 50C which is identical to the dual slide track 50B of FIG. 13 but for the deletion of one of the slide tracks 52B or 54B.

Figure 15:
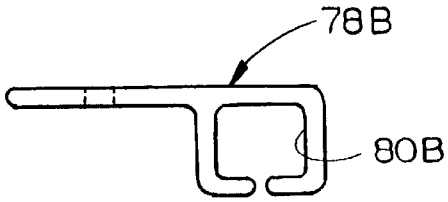
FIG. 15 is an end view of an alternate single slide track of the invention for receiving the suspension sheet of FIG. 7.
Figure 16:
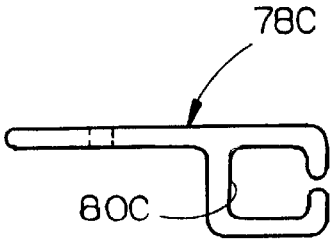
FIG. 16 is an end view of another alternative single slide track of the invention for receiving the suspension sheet of FIG. 7.

FIGS. 15 and 16 illustrate further embodiments of single slide tracks 78B and 78C which correspond to the single slide tracks of FIGS. 11 and 12 except that the C-channels 80B and 80C are of a generally square size and shape for slidably receiving the square guide strips 28A on suspension sheet 22A of FIG. 7.

Other embodiments may provide guide strips having a triangular cross-sectional shape and slide tracks defining guide strip receiving channels with a similar triangular shape for slidably receiving the triangular guide strips therein. Likewise, other cross-sectional shapes could be accommodated for both the guide strips and slide tracks.

Figure 17:
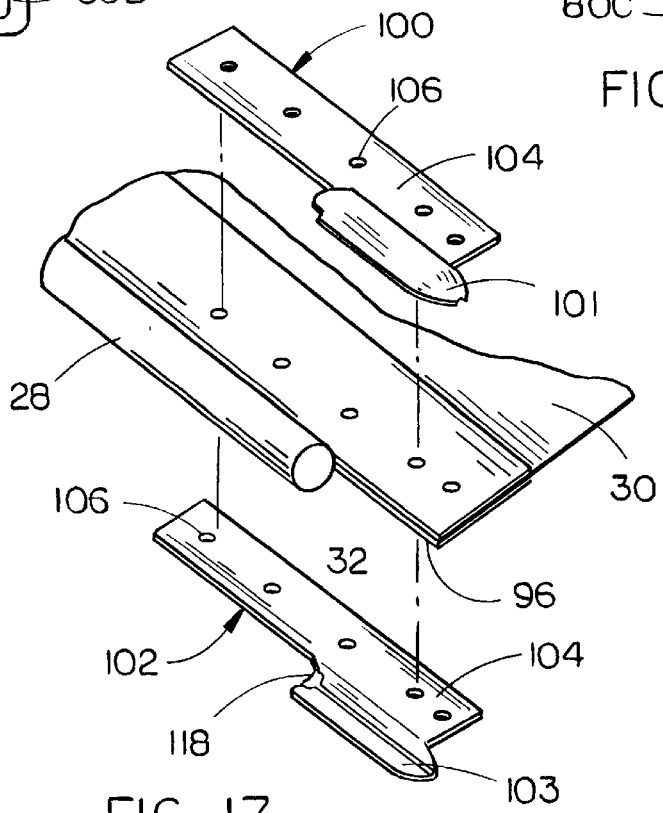
FIG. 17 is a perspective view of a leading corner of the suspension sheet.
Figure 18:
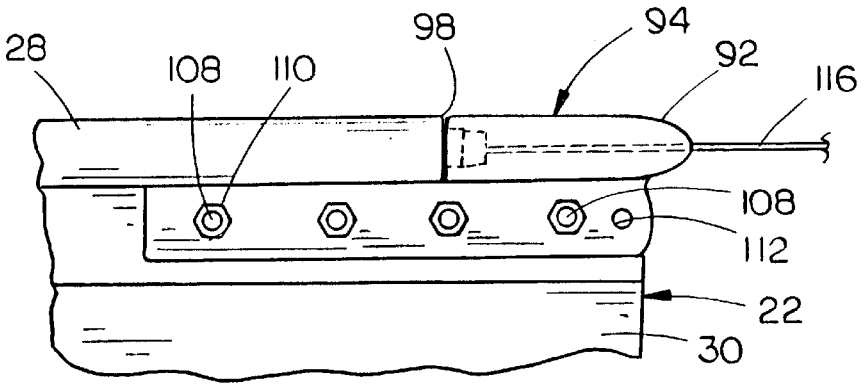
FIG. 18 is an exploded view of a leading corner of the suspension sheet illustrating the steel guide.
Figure 19:
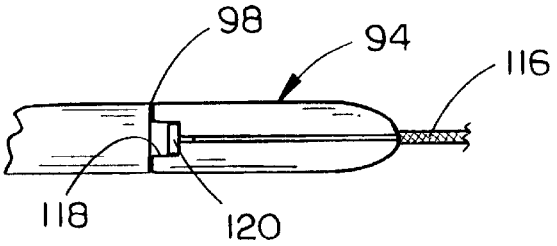
FIG. 19 is a side view of the steel guide and suspension sheet.

Referring to FIGS. 17, 18 and 19, the leading corners 92 of each suspension sheet 22 and one lead corner of each edge suspension sheet 42 include a guide bullet 94 for leading each, guide strip 28 through its respective slide track 20. At each such leading corner 92, flexible fabric 30 is notched as at 96 and a length of the guide strip 28 including cord 32 is cut back, as shown at 98 to afford space for inserting the guide bullet 94 ahead of the cord 32.

In the illustrated embodiment, guide bullet 94 is provided as two half-sections 100 and 102, each including a respective half bullet 101 and 103 connected to a mounting flange 104 having a series of bolt holes 106 for receiving bolts 108 and nuts 110 to securely sandwich and clamp suspension sheet 22 between them. The suspension sheet is reinforced at the point of clamping by the edge over half-sections 36 and 38. A pull-hole 112 is provided adjacent the leading edge of mounting flanges 104 for attachment of a wire or rope for pulling the suspension sheet along the slide tracks if the powered cable described below is not used.

To automatically pull the suspension sheet up and through the slide tracks, an electric winch 114, as shown in FIG. 2, may be provided at one end of each slide track. The cable 116 from the winch is directed back through the slide track for engaging guide bullet 94 at the leading end of the guide strip 28 to be drawn through that respective slide track 20. The guide bullet is notched at 118 for receiving the pull-head or bead 120 on the end of the cable 116. Upon activation of winch 114 to draw in cable 116, the suspension sheet is automatically drawn into and along the length of the slide track to substantially cover the walls and roof structure between the slide tracks engaging the slide tracks of suspension sheet 22. Whereas a single winch would suffice for an edge suspension sheet 42, a pair of winches 114 would be required for drawing in suspension sheet 22 having a guide strip along each edge thereof.

Figure 20:
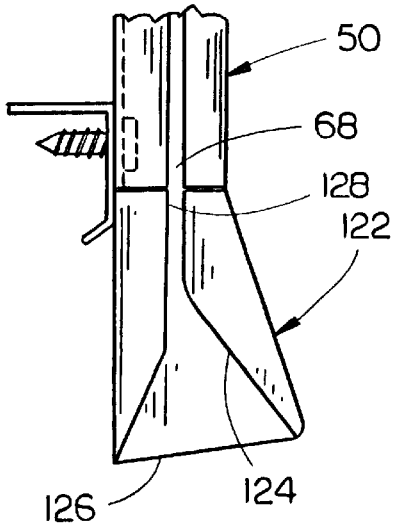
FIG. 20 is a side view of the feed-in fitting for directing a suspension sheet into the slide track.

Referring to FIGS. 2 and 20, a flared feed-in fitting 122 may be detachably or permanently secured to one end of each slide track 20 that is to receive a suspension sheet. Fitting 122 has a tapered slit 12 having a free wide end 126 for receiving a guide strip 28 and a narrow end 128 aligned with the slit 68 in the slide track 50 or 78 onto which the fitting is connected. The guide strips 28 are easily advanced into the wide end 126, whereupon they are precisely centered for advancement into and through the slits 68 without precise manual adjustment by the installers.

Figure 21:
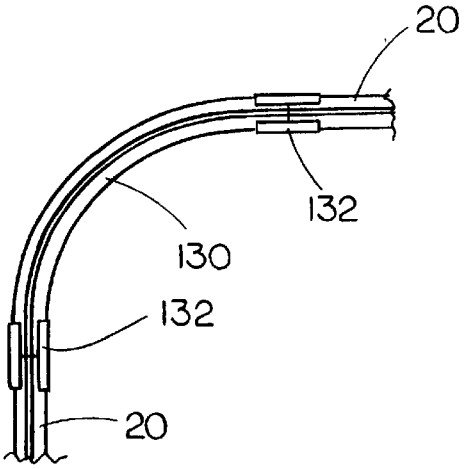
FIG. 21 is a partial side view illustrating the slide track at the junction of the roof structure and a side wall.
Figure 22:
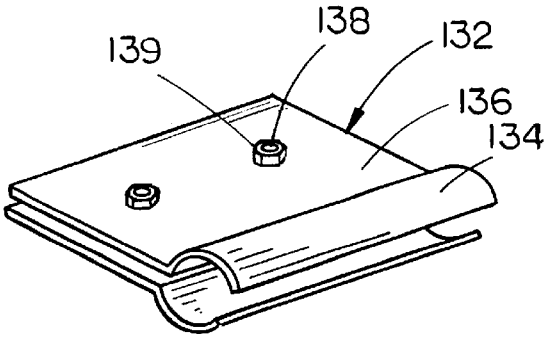
FIG. 22 is a perspective view of a coupler for joining a straight run of a slide track with a curved corner section.

If the slide tracks 20 are not of a bendable material, the bend at the junction of the rafters and side wall columns may be provided by curved inserts 130 having opposite ends which are connected to the adjacent straight lengths of slide tracks 20 by couplers 132 as shown in FIGS. 21 and 22. Coupler 132 is of the type adapted for use with single slide tracks 78A of FIG. 12. Each half-section of the coupler includes a partial cylindrical clamp jaw 124 and a connecting flange 136, adapted for securement together by any suitable means such as the bolts 138 and nuts 139. For the dual slide tracks 50, the couplers may be lengths of channel designed to fit within and engage the central channels 70 of each curved insert and the adjacent straight length of slide track. Any other suitable coupler could be used to connect straight and curved portions of slide track.

In operation, the slide tracks 20 are first secured to the secondary structural members of the building in parallel spaced-apart relation. If only the roof structure is being covered and insulated, the slide tracks would simply extend from eave to ridge to the opposite eave. In instances where both the walls and roof structure are to be covered and insulated, the slide tracks would extend up one side wall, across the roof structure and down the opposite side wall, as illustrated in FIG. 2. The side wall slide tracks are aligned with and connected to the roof structure slide tracks so that a single elongated length of suspension sheet 22 can be drawn up one side wall, across the roof structure and down the opposite side wall to cover the entire portion of the bay between the two slide tracks which support it. A length of suspension sheet 22 has a standardized width to accommodate a standard spacing between the slide tracks.

Figure 3:
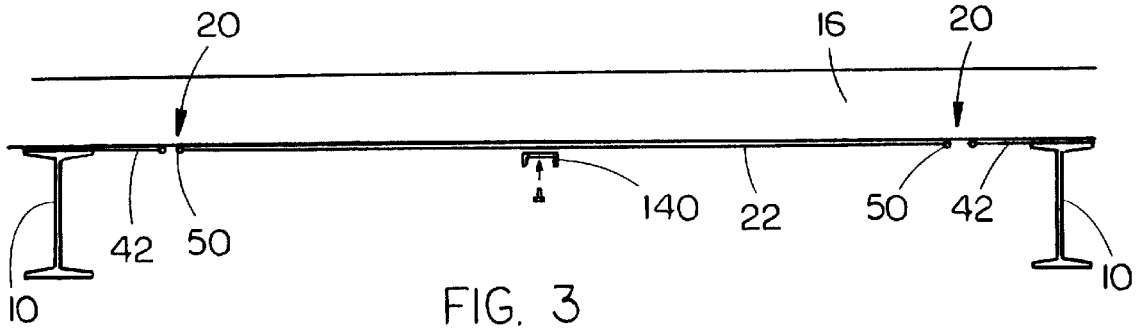
FIG. 3 is a partial side sectional view of a section of the roof structure including the system of the invention.

FIG. 3 illustrates the typical placement and spacing of the slide tracks 20 with respect to the primary structural members or rafters 10 in a roof structure. Each slide track is connected to a plurality of purlins 16 in spaced relation from the rafter 10, that spacing being approximately one foot. It is important that the spacing between the slide tracks 20 and 20 be precisely maintained to afford a tight uniform appearance for the suspension sheet after it is installed. FIG. 3 shows a center retainer channel which may be secured to the purlins 16 at a position intermediate to the slide tracks 20. That would typically be used for wider expanses of suspension sheets to minimize sagging between the slide tracks. The retainer channel 140 would typically have a cross section similar to central channel 70 of dual slide track 50 so that it likewise may perform the dual function as an electrical conduit if desired.

In certain wide spances between rafters 10, three dual slide tracks may be arranged for supporting a pair of suspension sheets in side-by-side relation across the bay.

Figure 4:
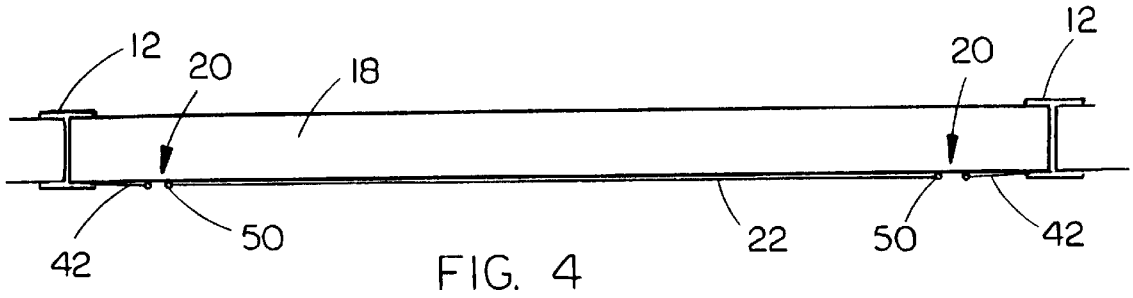
FIG. 4 is a partial sectional view of a section of a building side wall illustrating the system of the invention.

Likewise, FIG. 4 shows the securement of slide tracks 20 to girts 18 of a side wall. The slide tracks on the side walls are likewise arranged parallel to one another and of a spacing for taut installation of the suspension sheet between them. In the preferred embodiment, the slide tracks are arranged vertical on the side walls and end walls, parallel to the rafter columns. In other embodiments, the slide tracks could run horizontally across the walls, especially on flat masonry walls such as basements, precast panel walls and the like.

The gap between each primary structural member and the adjacent slide track is covered and sealed by an edge suspension sheet 42, as shown in FIG. 8. The guide strip 28 of edge suspension sheet 42 is inserted into the slide track closest to the primary structural member and pulled along the length of the slide track to advance the edge suspension sheet into its installed position. The free side edge of edge suspension sheet 42 is then extended to the primary structural member and secured to it by any suitable, means, such as adhesive, double-stick tape or mechanical fasteners, as were used for securing the vapor barrier sheet in the prior Simple Saver System.

Referring to FIG. 2, suspension sheet 22 and edge suspension sheet 42 are typically brought to the installation site in either fan-folded form, as indicated at 150 in FIG. 2, or in a roll, as indicated at 160 in FIG. 2.

For large installations, it is helpful to use winches 114 to automatically advance the suspension sheet up one side wall, across the roof structure and down the opposite sidewall. To accomplish this, winch cable 116 is withdrawn and directed up through slide track 20 in a reverse direction to the extent that the end bead 120 protrudes from feed-in fitting 122 at the opposite end of the slide track. Cable bead 120 is secured to guide bullet 94 of the adjacent edge of suspension sheet 22, whereupon winch 114 is activated to retract the cable and automatically advance the suspension sheet into place. Alternatively, the installers can connect a wire or other tension member to pull hole 112 of guide bullet 94 to manually advance suspension sheet 22 or edge suspension sheet 42 along the full length of the respective slide track.

Finally, the opposite ends of suspension sheet 22 or edge suspension sheet 42 are trimmed if necessary and likewise secured to the building structure by adhesive, double-stick tape, mechanical fasteners or by any other suitable fastening system. In wet use buildings such as automobile facilities, swimming pools, auditoriums and the like, an improved vapor barrier can be provided by caulking the junctions between the suspension sheets 22 and the slide tracks. This is preferably done with a small, continuous bead of a clear polyurethane caulk.

The system of the present invention both facilitates and expedites installation of the vapor barrier and/or insulation in a building. For example, in a metal building wherein one length of suspension sheet may have an area of 2,500 square feet, suspension sheet 22 can typically be pulled into place along the slide tracks in five minutes, with an additional five minutes to seal the edges for a total installation time of ten minutes per suspension sheet.

Whereas the invention has been shown and described herein in connection with preferred embodiments thereof, it is understood that additions, modifications and substitutions may be made which are within the intended broad scope of the appended claims. For example, whereas the invention will often be used in metal buildings, it is equally suited for structures that have only primary structural members such as steel or wood trusses, bar joists, concrete tees, etc. and for those flat surfaces such as flat masonry walls in basements, precast panel walls and the like.

Thus there has been shown and described an improved system for covering, sealing and/or insulating a building which accomplishes at least all of the stated objects.

I claim:

1. In a building roof structure including a plurality of spaced-apart parallel rafters and a plurality of purlins connected to and extended between said rafters in spaced-apart relation, a system for covering said roof structure between pairs of said rafters, comprising:

an elongated suspension sheet having opposite parallel side edges, said suspension sheet comprising a pair of guide strips and a flexible fabric connected to and extended between said pair of guide strips, each guide strip being of substantially greater thickness than said flexible fabric, one guide strip being arranged along each side edge of said suspension sheet, a first pair of slide tracks secured to said purlins in parallel spaced-apart relation generally parallel to and spaced inwardly between a pair of said rafters, said first pair of slide tracks including a right slide track and a left side track, said right slide track having a guide strip receiving channel and a slit along the length thereof and said left slide track having a guide strip receiving channel and a slit along the length thereof, said slits having a thickness greater than the thickness of said flexible fabric but substantially less than the thickness of said guide strips, said suspension sheet supported on and extending along the length of said slide tracks, one guide strip being received within the guide strip receiving channel of said left slide track and the other guide strip being received within said guide strip receiving channel of said right slide track and said flexible fabric extending through the slits in said right and left slide tracks whereby said suspension sheet substantially covers that portion of said roof structure between said first pair of slide tracks.

2. The system of claim 1 further comprising thermal insulation material supported on said suspension sheet.

3. The system of claim 1 wherein said suspension sheet is generally taut between said slide tracks.

4. The system of claim 1 wherein said suspension sheet extends throughout substantially the entire length of said slide tracks.

5. The system of claim 4 wherein each guide strip comprises a cord arranged adjacent said flexible fabric and an edge cover connecting said cord to said flexible fabric.

6. The system of claim 5 wherein said edge cover comprises a strip of fabric folded approximately in half with the cord arranged along the fold and the two half sections secured to top and bottom surfaces of said flexible fabric, respectively.

7. The system of claim 1 wherein each slide track comprises a generally C-channel with spaced-apart edges defining said slit disposed therebetween and means for securing said C-channel to a plurality of purlins.

8. The system of claim 7 wherein said means for securing said C-channel to a plurality of purlins comprises a support flange extended outwardly from said C-channel and a plurality of screw fasteners for securing said support flange to a plurality of purlins.

9. The system of claim 7 wherein at least one of said slide tracks comprises a dual slide track including right and left slide tracks for supporting adjacent side edges of adjacent suspension sheets.

10. The system of claim 9 wherein said right and left C-channels are arranged in spaced-apart relation, said means for securing said C-channels to said purlins comprising a center flange connected to and extended between said right and left C-channels and partially defining an open-bottomed central channel with said right and left C-channels.

11. The system of claim 10 further comprising an elongated closure strip having a length substantially equal to the central channel and means for removably securing said closure strip to the open bottom of said central channel to substantially enclose said central channel.

12. The system of claim 11 wherein said dual slide track and closure strip are adapted for snap fit connection of said closure strip over said central channel.

13. The system of claim 9 wherein one of said right and left C-channels of said dual slide track is arranged adjacent to and facing a primary structural member, said system further comprising an edge suspension sheet including an elongated flexible fabric strip having opposite side edges and one guide strip, of substantially greater thickness than said flexible fabric strip, secured to one side edge of said flexible fabric strip, said one guide strip being received within the guide strip receiving channel of said one of said right and left C-channels, and means for securing the opposite side edge of said flexible fabric strip to said primary structural member to close and seal the space between said dual slide track and said primary structural member.

14. The system of claim 13 wherein said means for securing the opposite side edge of said flexible fabric strip to said primary structural member comprises an adhesive material adhering said flexible fabric strip to said primary structural member.

15. In a building structure including a pair of opposite side walls, a pair of opposite end walls and a roof structure connected to and extending between said side walls and end walls, each wall and roof structure including a plurality of spaced-apart parallel primary structural members and a plurality of secondary structural members connected to and extended between said primary structural members in spaced-apart relation, a system for covering said roof structure and walls, between pairs of adjacent primary structural members comprising:

an elongated suspension sheet having opposite parallel side edges, said suspension sheet comprising a pair of guide strips and a flexible fabric connected to and extended between said pair of guide strips, said guide strips each being of substantially greater thickness than said flexible fabric, one guide strip being arranged along each side edge of said suspension sheet, a first pair of slide tracks secured to said secondary structural members in parallel spaced-apart relation generally parallel to and spaced inwardly between a pair of said primary structural members, said first pair of slide tracks including a right slide track and a left slide track, said right slide track having a guide strip receiving channel and a slit along the length thereof and said left slide track having a guide strip receiving channel and a slit along the length thereof, said slits having a thickness to accommodate passage of said flexible fabric therethrough, said suspension sheet supported on and extended along the length of said slide tracks, one guide strip being received within the guide strip receiving channel of said left slide track and the other guide strip being received within said guide strip receiving channel of said right slide track and said flexible fabric extending through the slits in said right and left slide tracks whereby said suspension sheet substantially covers the space between said first pair of slide tracks.

16. The system of claim 15 wherein said pair of slide tracks extend across said roof structure and vertically along at least one of said opposite side walls.

17. The system of claim 16 wherein each slide track includes a curved connector at the junction of said roof structure and each side wall to facilitate sliding installation of said suspension sheet along the length of said first pair of slide tracks.

18. The system of claim 17 further comprising a flared feed-in fitting on one end of each slide track, said fitting having a tapered slit having a free wide end for receiving a guide strip and a narrow end aligned with the slit in the respective slide track.

19. The system of claim 7 wherein at least one of said slide tracks comprises a dual slide track including right and left slide tracks for supporting adjacent side edges of adjacent suspension sheets.

20. The system of claim 19 wherein said right and left C-channels are arranged in spaced-apart relation, said means for securing said C-channels to said purlins comprising a center flange connected to and extended between said right and left C-channels and partially defining an open-bottomed central channel with said right and left C-channels.

21. The system of claim 20 further comprising an elongated closure strip having a length substantially equal to the central channel and means for removably securing said closure strip to the open bottom of said central channel to substantially endose said central channel.

22. The system of claim 19 wherein one of said right and left C-channels of said dual slide track is arranged adjacent to and facing a primary structural member, said system further comprising an edge suspension sheet including an elongated flexible fabric strip having opposite side edges and one guide strip, of substantially greater thickness than said flexible fabric strip, secured to one side edge of said flexible fabric strip, said one guide strip being received within the guide strip receiving channel of said one of said right and left C-channels, and means for securing the opposite side edge of said flexible fabric strip to said primary structural member to close and seal the space between said dual slide track and said primary structural member.

23. The system of claim 22 wherein said means for securing the opposite side edge of said flexible fabric strip to said primary structural member comprises an adhesive material adhering said flexible fabric strip to said primary structural member.

24. A method of covering one or more walls of a building, said walls including a pair of opposite side walls, a pair of opposite end walls and a roof structure connected to and extending between said side walls and end walls, each wall including a plurality of spaced-apart parallel primary structural members and a plurality of secondary structural members connected to and extended between said primary structural members in spaced-apart relation, said method including:

providing an elongated suspension sheet having opposite parallel side edges, said suspension sheet comprising a pair of guide strips and a flexible fabric connected to and extended between said pair of guide strips, each guide strip being of substantially greater thickness than said flexible fabric, one guide strip being arranged along each side edge of said suspension sheet, providing a first pair of slide tracks including a right slide track and a left slide track, each having a guide strip receiving channel and a slit along the length thereof, said slit having a thickness sufficient to accommodate passage of said flexible fabric therethrough, securing said first pair of slide tracks to a plurality of said second structural members in parallel spaced-apart relation and spaced inwardly generally parallel to and between a pair of said primary structural members, and installing said suspension sheet onto a wall by inserting the guide strips thereof into said right and left slide tracks, respectively, with said flexible fabric extended through said slide track slits, and sliding said suspension sheet along the length of said slide tracks, thereby covering the space between said first pair of slide tracks.

25. The method of claim 24 wherein said securing step further comprises spacing said first pair of slide tracks apart such that upon installation of said suspension sheet, said suspension sheet is generally taut.

26. The method of claim 25 wherein said securing step further comprises securing said first pair of slide tracks across said roof structure and down at least one side wall.

27. The method of claim 26 wherein said suspension sheet is substantially as long as said first pair of slide tracks and said installing step further comprises advancing said suspension sheet along substantially the entire length of said first pair of slide tracks.

28. The method of claim 24 wherein providing a first pair of slide tracks comprises providing at least one of said slide tracks as a dual slide track including right and left slide tracks for supporting adjacent side edges of adjacent suspension sheets, said securing step comprising securing said dual slide track adjacent to but spaced from a primary structural member, and further comprising providing an edge suspension sheet including an elongated flexible fabric strip having opposite side edges and one guide strip along one side edge thereof, inserting said guide strip into the slide track closest to said primary structural member and pulling said edge suspension sheet along the length of said slide track, extending said edge suspension sheet to said primary structural member to cover the space between said primary structural member and said slide track and securing the opposite side edge of said edge suspension sheet to said primary structural member.

29. The method of claim 28 further comprising providing multiple dual slide tracks, securing said multiple dual slide tracks to said secondary structural members in spaced-apart relation and installing suspension sheets between said dual slide tracks, thereby covering substantially the entire roof structure and at least one side wall with said suspension sheets and edge suspension sheets.

30. The method of claim 29 further comprising covering substantially all of said roof structure, side walls and end walls with said dual slide tracks, suspension sheets and edge suspension sheets.

31. The method of claim 28 wherein each dual slide track includes spaced-apart right and left slide tracks defining a central channel therebetween, providing electrical wires for said building, running said electrical wires through said central channel and enclosing said central channel to serve as a conduit for said electrical wires.

32. The method of claim 24 further comprising providing a plurality of thermal blocks and said step of securing said first pair of slide tracks to a plurality of said secondary structural members comprises inserting a thermal block between each slide track and each secondary structural member to which it is secured, thereby to reduce thermal conduction between them.

* * * * *